US005582471A

United States Patent [19]

Lin

[11] Patent Number: 5,582,471

[45] Date of Patent: Dec. 10, 1996

[54] ENVIRONMENTAL PROTECTIVE TABLE

[76] Inventor: Cheng-I Lin, 7th Fl. No. 1-1, Lane 61, Sec. 4 Cheng-kung Rd. Nei-Hu Dist., Taipei, Taiwan

[21] Appl. No.: 441,206

[22] Filed: May 15, 1995

[51] Int. Cl.[6] ..... A47G 29/14; A47B 13/02

[52] U.S. Cl. ..... 312/211; 312/328; 312/319.9; 312/100; 108/25; 108/50; 108/150

[58] Field of Search ..... 312/211, 100, 312/102, 196, 283, 194, 328, 319.9, 235.5; 108/25, 50, 150; 135/96, 98, 99; 248/907; 211/70.6, 196, 197

[56] References Cited

U.S. PATENT DOCUMENTS

| | | | |
|---|---|---|---|
| 1,219,905 | 3/1917 | Barringer | 135/96 |
| 2,838,351 | 6/1958 | Siconolfi et al. | 108/25 |
| 4,623,367 | 11/1986 | Paulson | 108/50 X |
| 4,625,656 | 12/1986 | Brickman | 108/25 |
| 4,901,998 | 2/1990 | Griffith | 108/150 X |
| 5,322,023 | 6/1994 | Hammond | 108/50 |
| 5,330,263 | 7/1994 | Wilkinson | 312/328 |
| 5,353,716 | 10/1994 | Wilbert | 108/150 |
| 5,390,944 | 2/1995 | Sherwin | 211/70.6 X |

*Primary Examiner*—Peter M. Cuomo
*Assistant Examiner*—James O. Hansen
*Attorney, Agent, or Firm*—Harrison & Egbert

[57] ABSTRACT

A combination environmental protection table including a table plate having a hole formed centrally thereof and a recess formed on a bottom surface thereof, a bowl-shaped main body having an opening at a bottom thereof and a mouth formed in a side thereof, a post member formed by a truss and a door panel arranged in a cylindrical configuration having an interior trash-containing volume, a base having a top surface with a groove therein for receiving the post member therein, and a thimble member extending through the interior of the base, the post member, the main body and the table plate. The mouth of the main body has a lid extending thereover. The lid allows trash to enter the mouth. The main body is affixed into the recess of the table plate. The thimble member includes an upper thimble portion and a lower thimble portion. The upper thimble portion has an opening at a top thereof and a flange extending radially outwardly of the opening at the top. The lower thimble portion has an opening at a bottom thereof and has a flange extending radially outwardly therefrom. The upper and lower thimble portions are joined together in the form of an axial pipe.

8 Claims, 7 Drawing Sheets

511
51
5
10
101
103
102
9
702
901
70
701
7
71
712
711
621
611
20
62
202
5
502
50
501
322
323
313
311
31
312
401
402
412
40
411
41
602
601
60
321
32
30
611
324
61
612

ENVIRONMENTAL PROTECTIVE TABLE

BACKGROUND OF THE INVENTION

1. Fielf of the Invention

This invention relates to a combination table, especially a table which is easy to combine, carry and deliver and can be used as a trash can for protecting the environment.

2. Prior Arts of the Invention

A conventional leisure table with a parasol can only be used as a dining table or a table for leisure activity. People need trash can and cigarette ash tray when they are dining or smoking at the table. The conventional leisure table does not provide a trash can and ash tray to satisfy the users.

SUMMARY OF THE INVENTION

The present invention is an combination environmental protection table which contains a hollow table body with an area on the interior which serves as a trash container. The present invention is easy to combine, dismantle, carry and convey.

In particular, the present invention includes a table plate having a hole formed centrally therein, a bowl-shaped main body, a post member, a base and a thimble member. The table plate has a recess formed on a bottom surface of the table plate. The bowl-shaped main body has an opening at a bottom thereof. The main body has a mouth formed in a side thereof. A lid extends over the mouth in the side of the main body. The lid allows trash to enter into the mouth. The main body is affixed into the recess of the table plate. The bottom of the main body has a groove extending therearound. The post member is formed by a truss and a door panel arranged in a cylindrical configuration and having an interior trash-containing volume. The post member is received within the groove of the main body. The base has a top surface with a groove formed therein. The groove receives the truss therein so as to support the post member above the base. The base has a foot extending outwardly from a bottom thereof. The thimble member has an upper thimble portion and a lower thimble portion. The upper thimble portion has an opening at a top thereof and a flange extending radially outwardly of the opening of the top. The lower thimble portion has an opening at a bottom thereof. The bottom of the lower thimble portion has a flange plate extending radially outwardly therefrom. The upper thimble portion extends through the hole of the table plate and extends downwardly through the opening of the main body. The lower thimble portion extends through a hole in the base and extends upwardly through the main body. The upper and lower thimble portions are joined together in the form of an axial pipe.

The lid of the main body has a suspending arm extending outwardly therefrom. The suspending arm is received by a holding bar. The holding bar extends downwardly through the main body and through the post member so as to be connected to a pedal on the base. The pedal is pivotally connected to the base so as to protrude outwardly from the base. The pedal serves to open the lid when a force is applied to the pedal. A spring is interconnected between the suspending arm and the main body. The spring serves to urge the lid to a closed position when a force is not applied to the pedal.

The opening of the upper thimble portion receives a parasol rod therein. The parasol rod is a hollow rod having an opening at a top thereof. The thimble member has a plurality of holes formed radially outwardly therein. The plurality of holes are in air flow communication with the interior volume of the post member such that the air from the post member can pass through the parasol rod and outwardly of the opening at the top of the parasol rod. The opening at the top of the parasol rod has an inducing fan mounted therein. The inducing fan is driven by natural air currents.

The post member has a peeping window formed therein. The peeping window allows for viewing of the interior of the post member.

The present invention also includes a swinging tray base which is affixed to the bottom surface of the table plate. The base has a transverse hole formed therein. The transverse hole slidably receives a shaft of a tray holder therein. The tray holder removably receives an ash tray therein. The swinging tray base allows the tray holder to extend outwardly of the table plate.

The foot of the base has a balance weight box disposed therein.

BRIEF DESCRIPTION THE DRAWINGS

DETAILED DESCRIPTION OF THE PREFERRED EMBODIMENTS

Figure 1:
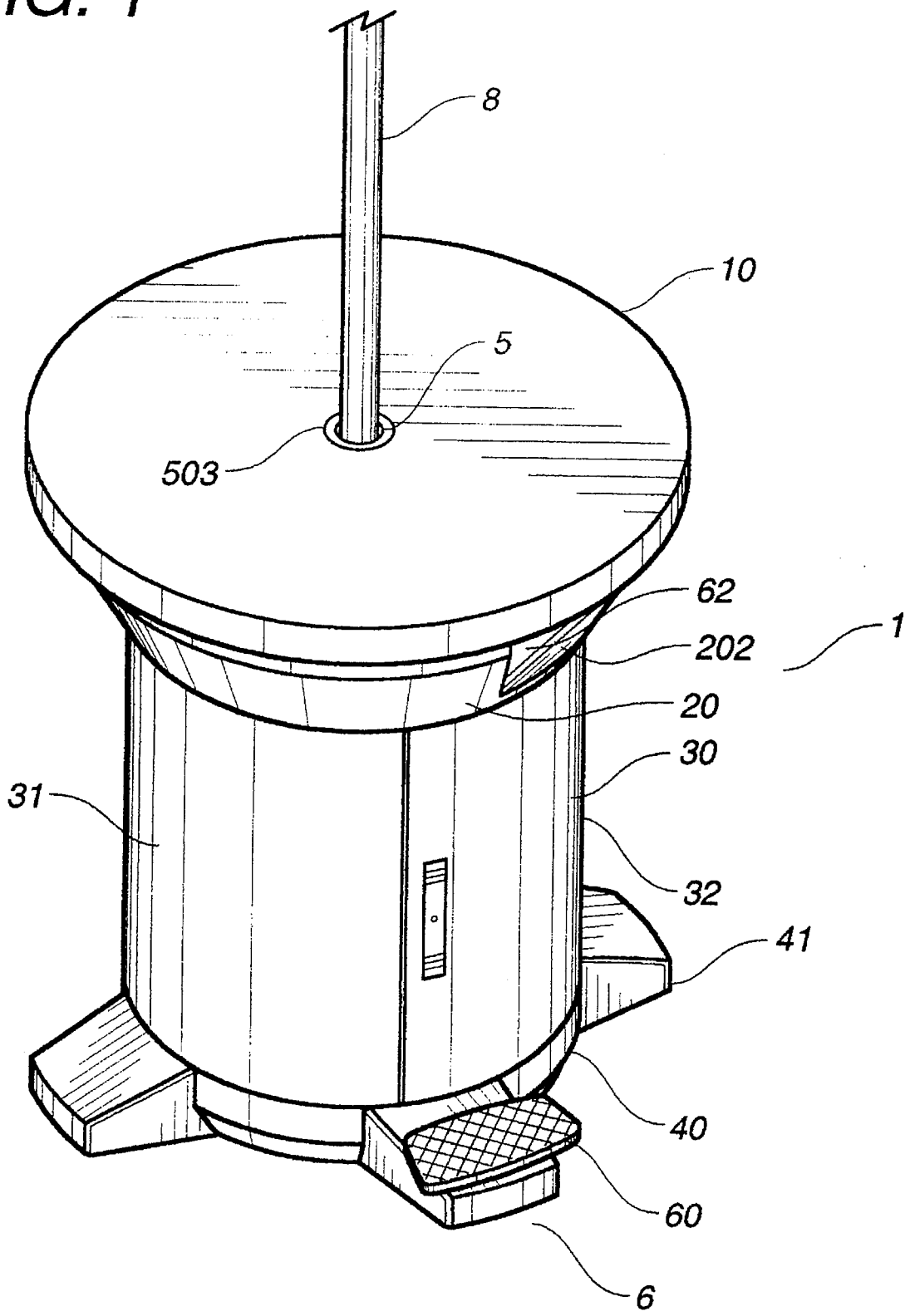
FIG. 1 is a pictorial schematic view of an embodiment of the invention.

As shown in FIG. 1, an environmental protective table (E.P.table) is a table body comprised of a table plate (10), a main body (20), a post (30), and a base (40), the table body is formed by fastening and connecting all the above parts one by one in order, wherein the table plate (10) at the top and the base at the bottom are connected and fastened firmly by a set of thimbles (5) which are also used as a socket for the rod (8) of a parasol to insert in them; as shown in FIG. 1, the rod (8) of the parasol can be firmly inserted in the opening (503) of the thimble (5).

Figure 2:
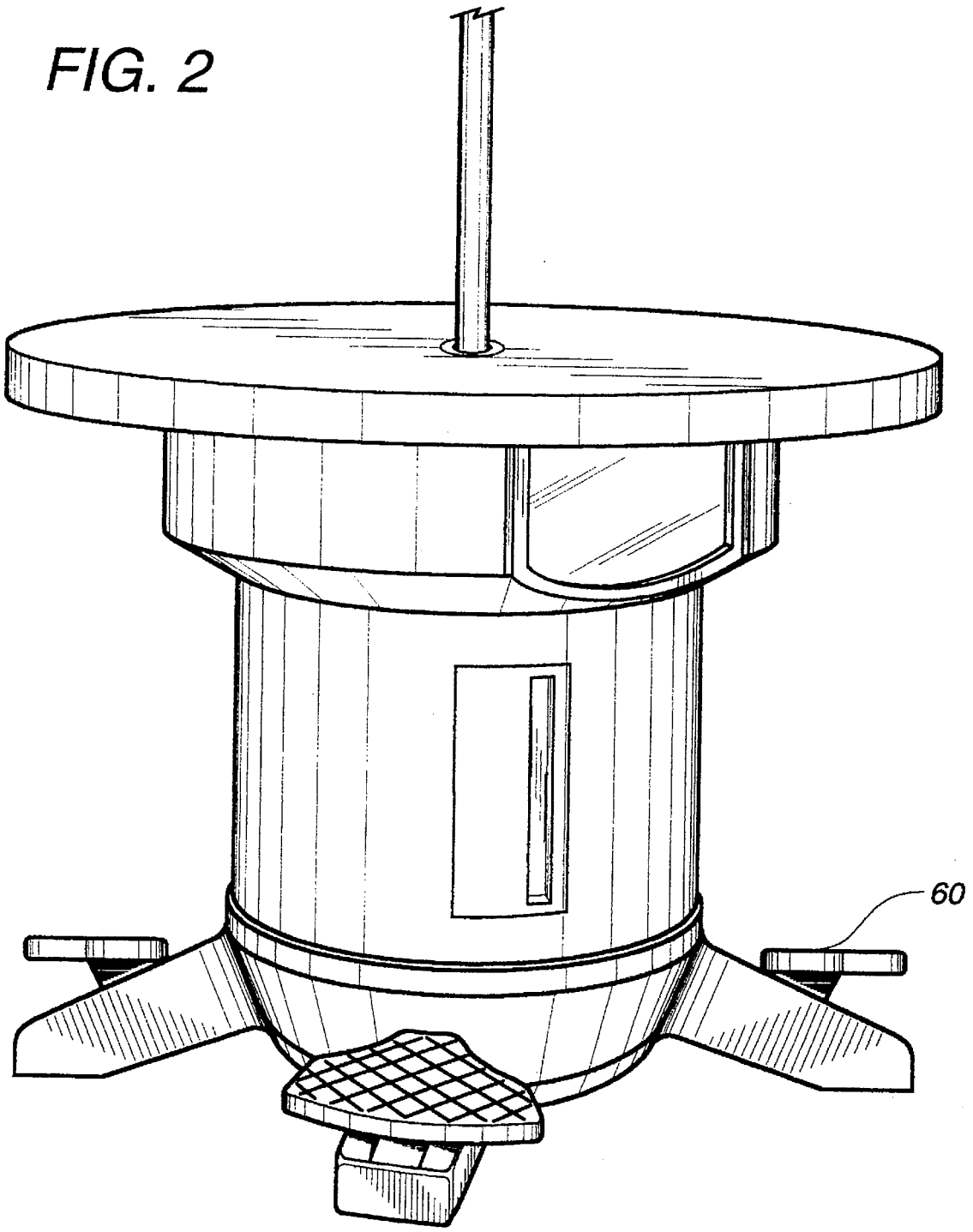
FIG. 2 is another pictorial schematic view of an embodiment of the invention.

The post (30) consists of at least one set of trusses (31) and one set of door panel (32). The trash-throwing mouth (202) is disposed on the main body (20). As shown in FIG. 1, the coupling mechanism (6) for the lid (62) on the trash-throwing mouth (202) has a pedal (60), the amount of the pedals (60) should equal to that of the lids (62). As shown in FIG. 2, only two sets of coupling mechanism (6) disposed on a lid (62) can be seen because it is a FIG only for reader's reference.

Figure 3:
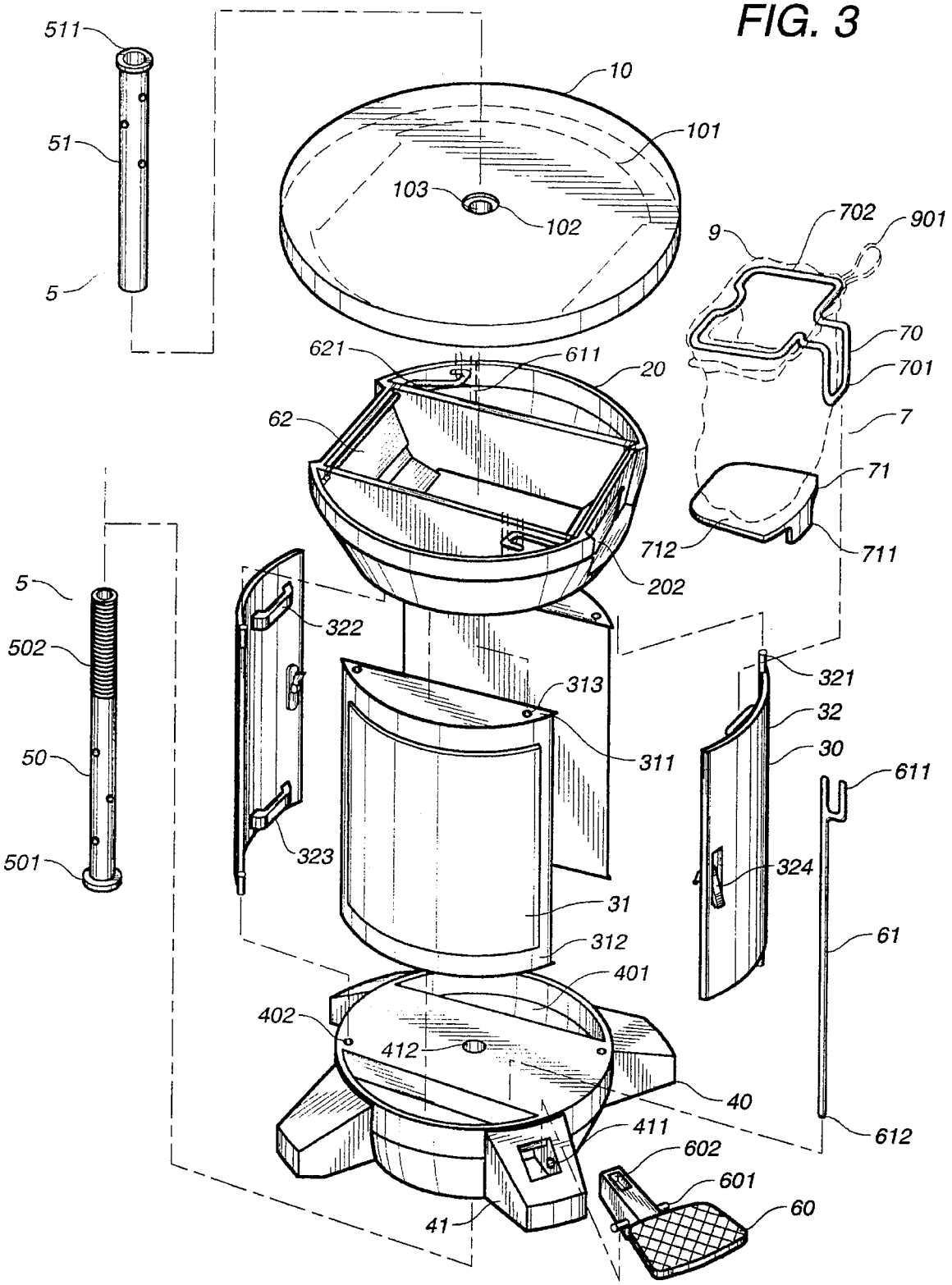
FIG. 3 is a pictorial structural analysis view of an embodiment of the invention.

As shown in FIG. 3, the explosive view of all parts of the E.P. table shown in FIG. 1, the top of the table is a table plate (10) with a flange (101) (a tenon used for connection) at its bottom, and in the center of the table plate (10) there disposed an opening (103) with a recess (102) on its top; beneath the table plate (10), there disposed the main body (20) with a trashthrowing mouth (202)on the side, the upper end of the lid (62) is a shaft which has an axial suspending arm (621) at its shaft end, (notes: the suspending arms can be fitted at both ends ) the big opening at the top of the main body (20) and the flange (101) at the bottom of the table plate (10) should have perfect fit; and there disposed a groove (201) (see FIG. 4) at the lower end of the main body (20) to fit the post (30) for connection; the post (30) is a cylinder comprised of a truss (31) and a door panel (32), and tenons (311, 312) can be fitted on both the upper and the lower ends of the truss (31) so that the main body (20) and the base (40) can be connected; the door panel (32) has a pair of longitude shaft pin (321) on its one side to insert in the shaft hole (402) of the main body (20) and the base (40) so that the door panel (32) can turn sideway, and there disposed a latch (324) on the other side of the door panel (32) so that the door panel can be locked; and at the top of the base (40), there disposed a slot (401) for the truss (31) to insert in and connect with each other; the truss (31) has downward foot (41) around it;the foot 41 has a hole for a pedal (60) to insert in it, on the inner wall of the hole, there disposed a shaft hole (402) for the shaft pin (601) of the pedal (60) to pivot in it; and there disposed a thimble hole (412) at the center of the base (40). There is also a coupling device (6) for the thimble (5) which is composed of an upper thimble (51) and a lower thimble (50); and a flange (511) is disposed on the upper end of the thimble (51), and a flange (501) is disposed on the lower end of the thimble (50): a female screw (512) is fitted on the inner bore of the upper thimble (51) at its lower end, and a male screw (502) is fitted on the upper end of the thimble (50) so that the two thimbles can be fastened to become a straight pipe rod; the coupling device (6) consists of a lever pedal (60), one end of the pedal (60) is a holding end (602) used to hold the lower end (612) of the holding bar (61), which has a forked head (611) at its top to fork and hold the end of the suspending arm (621) of the lid (62).

Figure 4:
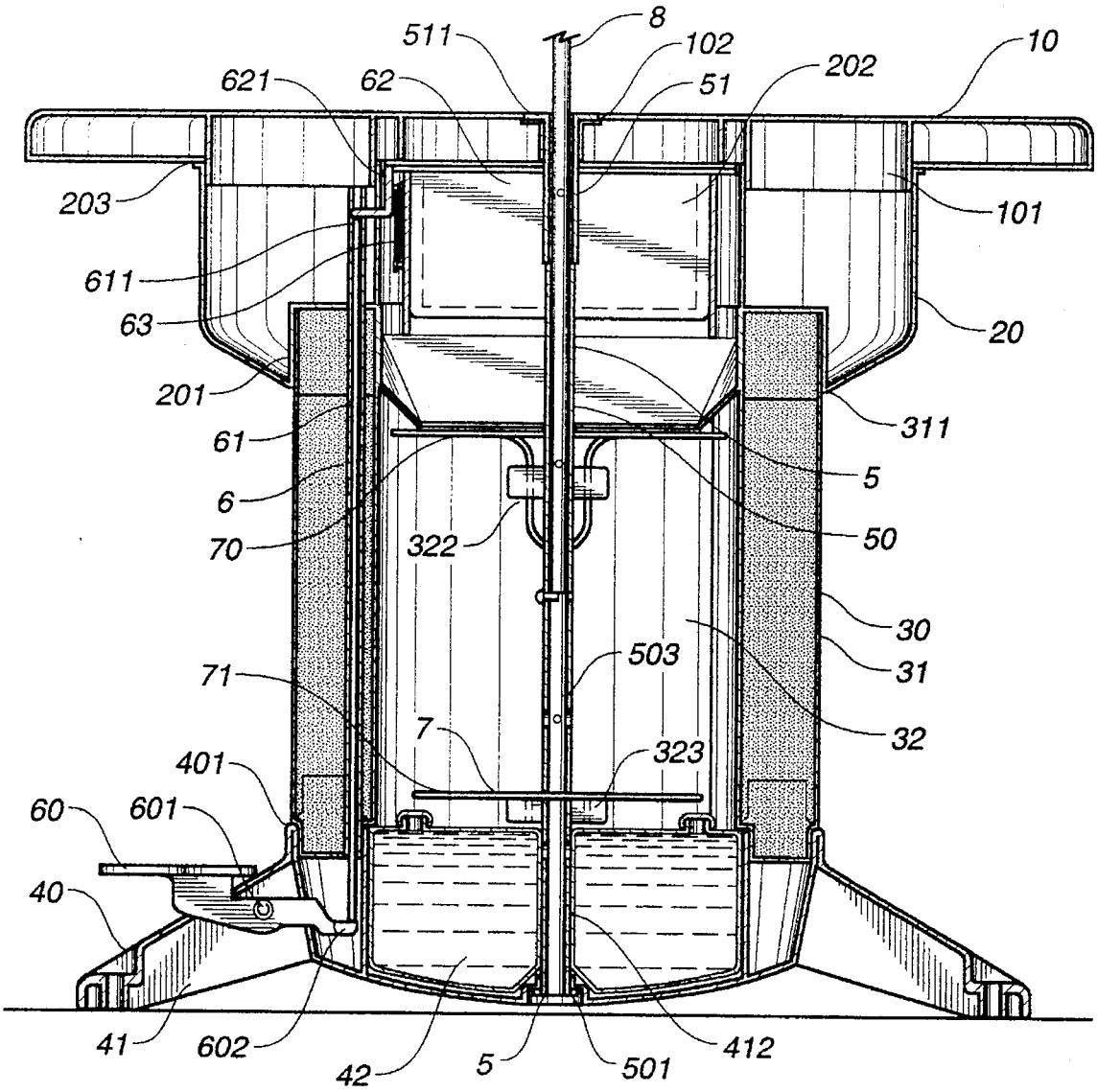
FIG. 4 is a longitude structural sectional view of the invention.

As shown in FIG. 4, the main members of the table, from its bottom to its top, are the base (40), post (30), main body (20), and table plate (10); they are connected and secured firmly together by the upper and lower thimbers (51, 50) of the central thimble (5) and thus fasten all the members to be an integrated body: also, as a whole, and the thimble (5) is hollow in its center so that the rod (8) of the parasol can insert in it.

As shown in FIG. 3,4, there disposed a socket (322) on the inner side of the door panel (32), the socket (322, 323) is used for the holding panel (71) and the holding panel (7') of the trash container (7) to insert in it; the truss (70) consists of a transverse frame (702) and an inserting piece (701) with an erect side, its frame (702) is used to lay on the mouth of the trash bag (9), the holding panel (71) also consists of a horizontal board (712) and an inserting piece (711) with an erect side, the inserting piece (711) is inserted in the socket (323), and the board (712) is disposed at the bottom of the trash bag (9) to hold the trash.

Figures 5, 6:
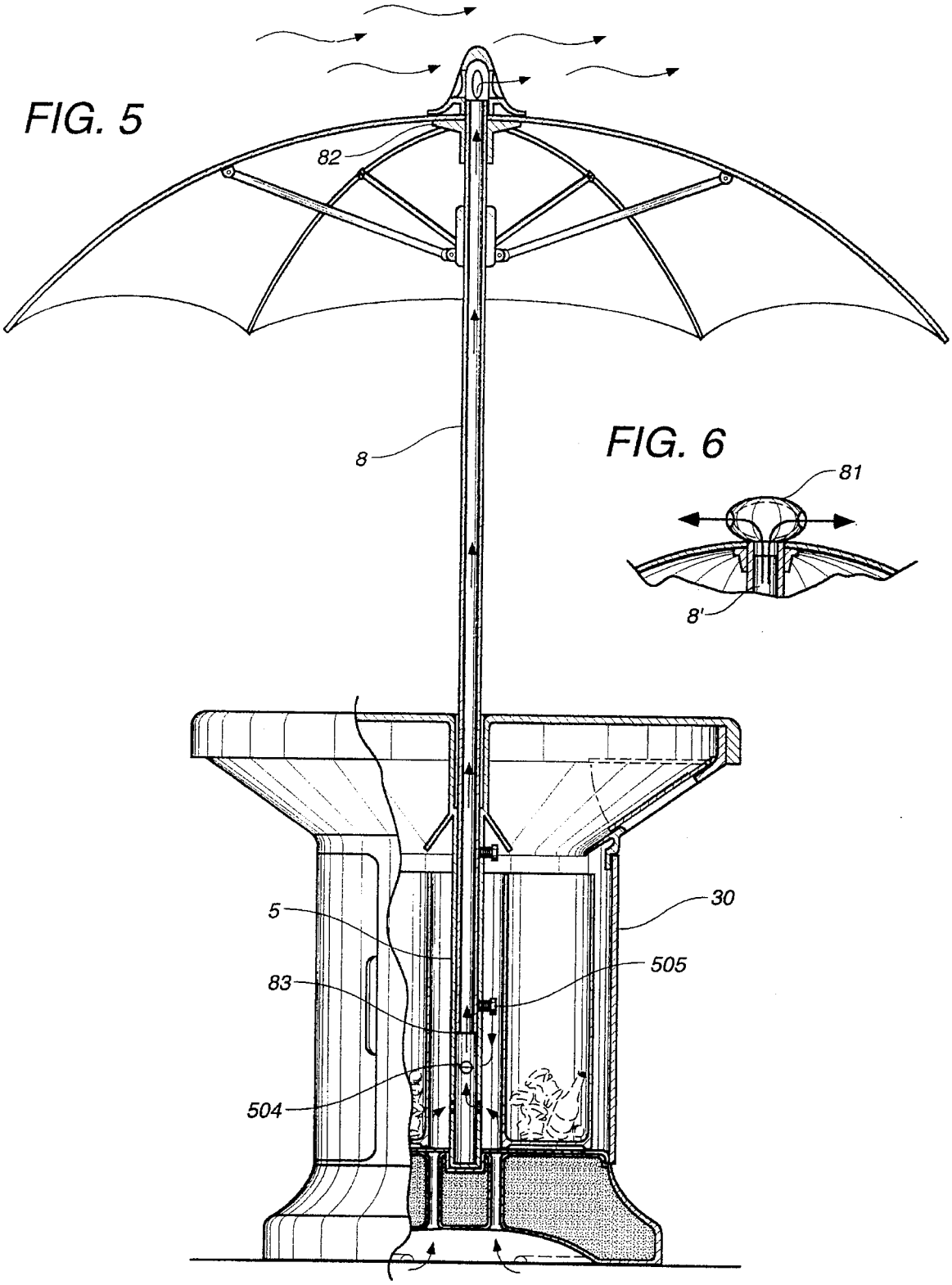
FIG. 5 is a view of the air exhaust device of an embodiment of the invention.
FIG. 6 is a schematic view of an additional inducing fan on the top of the air exhaust pipe (parasol rod).

As shown in FIG. 5, the rod (8') of the parasol inserted in the table body is a hollow pipe with a hole on its top so that the pipe becomes a chimney for the E.P.table, by means of the leading of natural air stream above the parasol panel, the parasol rod becomes an air exhaust pipe, and inner air will flow upward and gradually exhaust from the trash container (7). As shown in FIG 6, there can be an inducing fan (81) disposed on the top of the parasol rod; the fan (81) can be automatically rotated by natural wind so that the effectiveness of the air exhaust pipe can be reinforced.

Figure 7:
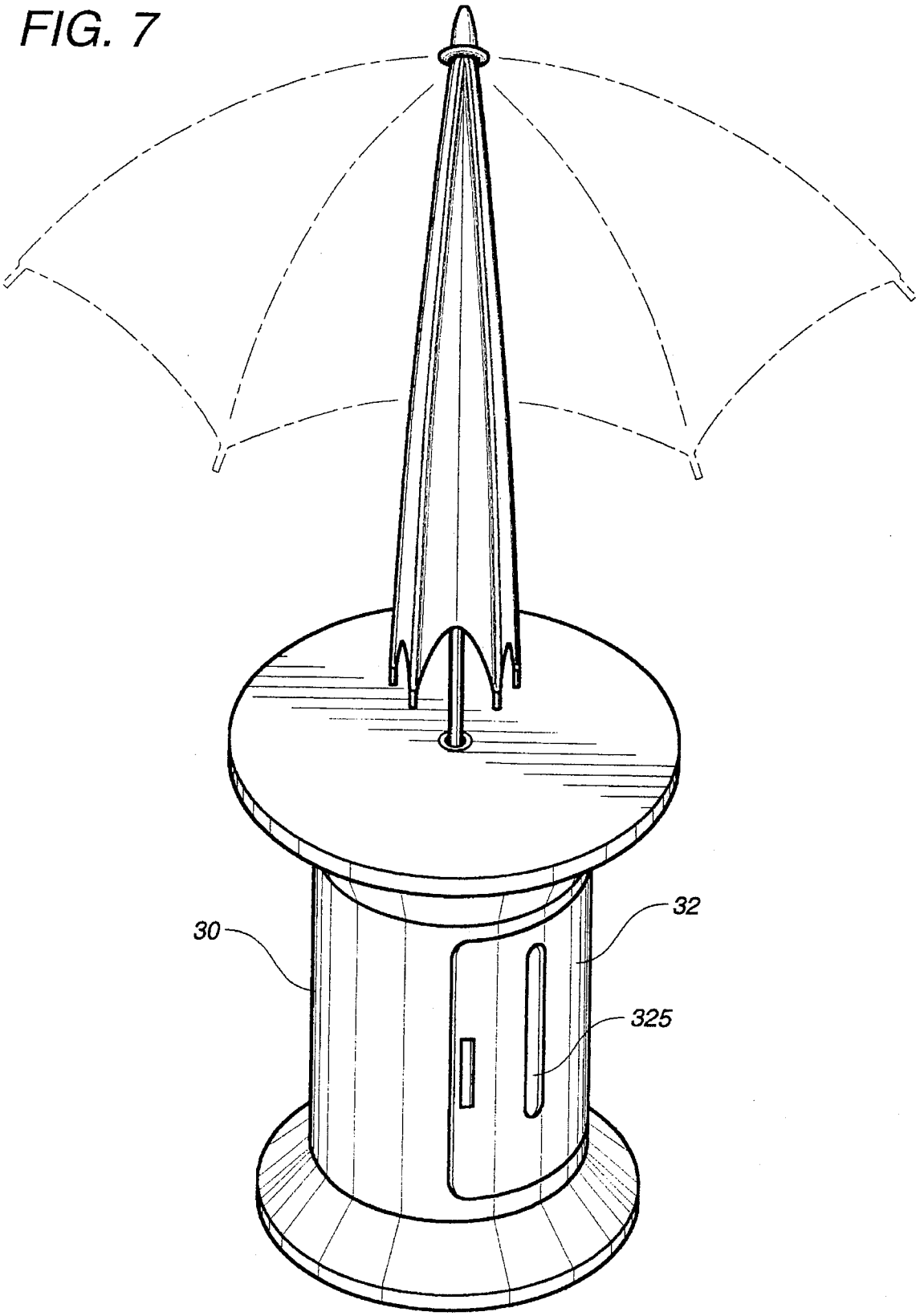
FIG. 7 is a schematic view of the peeping window on the table body.
Figure 8:
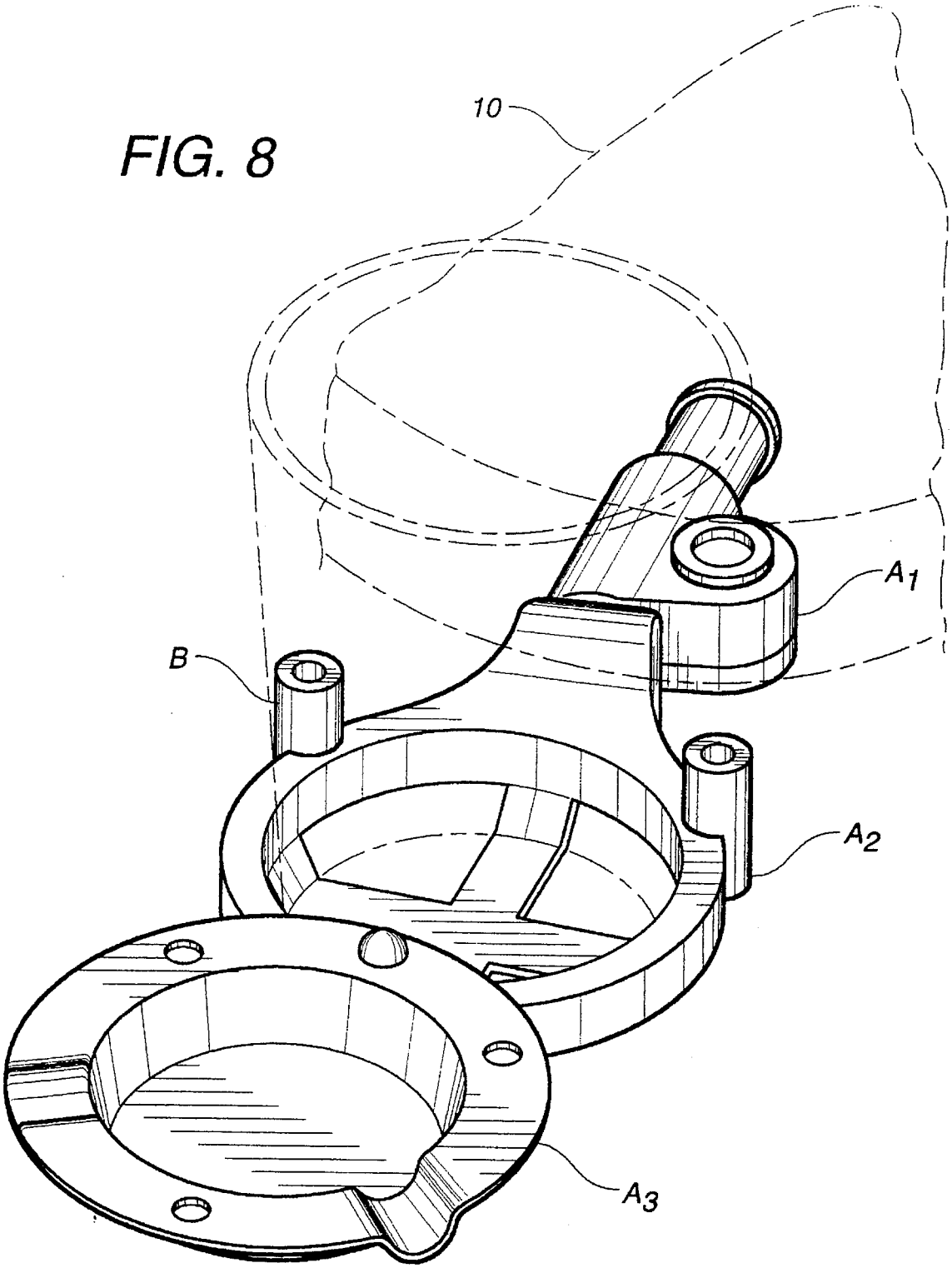
FIG. 8 is an installation view of a cigarette ash tray or a cup fitted under the table plate.

As shown in FIG. 7, the table body has a peeping window (325) on the side for users to see from outside how much trash has been accumulated in the container (7). As shown in FIG. 8, a cigarette ash tray device (A) is mounted under the table plate (10), the tray device (A) has a base (A1) , a holder (A2), and a tray (A3), wherein the base (A1) has a longitude hole and a transverse shaft hole; these two holes are crossed over each other: the longitude hole fits to a shaft pin so that the tray (A3) can be pivoted under the table plate (10), the tray holder (A2) has a round rod at its one end which is pivoted in the transverse shaft hole in the base (A1), and the holder (A2) can be transversely pulled. A tray (A3) is mounted on the other end of the holder (A2), when the tray (A3) is turned sideway and partially pulled out of the flange of the table plate (10), the tray (A3) is erectly mounted on the holder (A2). Because the surface of the tray (A3) is closely disposed under the table plate (10), and because part of its surface still contacts with the bottom surface of the table plate (10), the tray (A3) can erectly stand on the holder (A2) and be ready for use. When the tray (A3) is completely pulled out of the flange of the table plate (10), because the holder (A2) and the base (A1) are pivoted by a round rod, the tray (A3) can be over-turned to dump off its trash and cigarette ash. The tray may be replaced by a cup (B) or any small tableware set held by the holder (A2) so that it can be very convenient for the user to use it.

As shown in FIG. 4, a sealed balance weight box (42) is disposed in the foot (41) of the E.P. table. The balance weight box (42) has a seal lid at its top and contains stones, sand, and water in it in order to add weight to the table body and make it stand more stably in balance.

The present invention, "a combination environmental protective table", is effective and easy to combine or dismantle and convenient for carry or delivery, especially it provides a set of thimbles to fix the parasol rod and all other parts of the table firmly together as a whole body.

What is claimed is:

1. A combination environmental protection table comprising:

a table plate having a hole formed centrally thereof, said table plate having a recess formed on a bottom surface of said table plate;

a bowl-shaped main body having an opening at a bottom thereof, said main body having a mouth formed in a side thereof, said mouth having a lid extending thereover, said lid for allowing trash to enter said mouth, said main body being affixed into said recess of said table plate, said bottom of said main body having a groove extending therearound;

a post member formed by a truss and a door panel arranged in a cylindrical configuration having an interior trash-containing volume, said post member being received within said groove of said main body;

a base having a top surface with a groove formed therein, said groove receiving said truss therein so as to support said post member above said base, said base having a foot extending outwardly from a bottom thereof; and a thimble member having an upper thimble portion and a lower thimble portion, said upper thimble portion having an opening at a top thereof and a flange extending radially outwardly of said opening at said top, said lower thimble portion having an opening at a bottom thereof, said bottom of said lower thimble portion having a flange plate extending radially outwardly therefrom, said upper thimble portion extending through said hole of said table plate and extending downwardly through said opening of said main body, said lower thimble portion extending through a hole in said base and extending upwardly toward said main body, said upper and lower thimble portions being joined together in the form of an axial pipe.

2. The table of claim 1, wherein said lid of said main body has a suspending arm extending outwardly therefrom, said suspending arm received by a holding bar, said holding bar extending downwardly through said main body and said post member so as to be connected to a pedal means on said base, said pedal means being pivotally connected to said base so as to protrude outwardly from said base, said pedal means for opening said lid when a force is applied to said pedal means.

3. The table of claim 2, wherein a spring means is interconnected between said suspending arm and said main body, said spring means for urging said lid to a closed position when the force is not applied to the pedal means.

4. The table of claim 1, wherein said opening of said upper thimble portion receives a parasol rod therein, said parasol rod being a hollow rod having an opening at a top thereof, said thimble member having a plurality of holes formed radially therein, said plurality of holes in air flow communication with said interior volume of said post member such that air from said post member can pass through said parasol rod and outwardly of said opening at the top of said parasol rod.

5. The table of claim 4, said opening at the top of said parasol rod having an inducing fan mounted thereon, said inducing fan being driven by natural air currents.

6. The table of claim 1, said post member having a peeping window means formed thereon, said peeping window for viewing the interior of said post member.

7. The table of claim 1, further comprising:

a swinging tray base affixed to said bottom surface of said table plate, said base having a transverse hole formed therein, said transverse hole slidably receiving a shaft of a tray holder therein, said tray holder removably receiving an ash tray therein, said swinging tray base allowing said tray holder to extend outwardly of said table plate.

8. The table of claim 1, wherein said foot of said base has a balance weight box disposed therein.

* * * * *